United States Patent [19]

Lemmer

[11] 4,277,660

[45] Jul. 7, 1981

[54] ADJUSTABLE FOOTREST

[76] Inventor: Alfred Lemmer, Machtlingerstrasse 24, D-8000 Munchen 70, Fed. Rep. of Germany

[21] Appl. No.: 71,264

[22] Filed: Aug. 30, 1979

[30] Foreign Application Priority Data

Sep. 5, 1978 [DE] Fed. Rep. of Germany ..... 2838654

[51] Int. Cl.[3] ..... H01H 19/16; H01H 21/26

[52] U.S. Cl. ..... 200/86.5; 74/512; 200/153 C

[58] Field of Search ..... 318/551; 200/86.5, 153 C, 200/318, 320, 321, 322, 335, 337, 339; 74/522, 560, 512–514

[56] References Cited

U.S. PATENT DOCUMENTS

| | | | |
|---|---|---|---|
| 2,944,120 | 7/1960 | Ruben | 200/86.5 |
| 3,691,868 | 9/1972 | Smith | 74/512 |
| 3,828,625 | 8/1974 | Bruhn, Jr. | 74/512 |
| 3,850,048 | 11/1974 | Moore | 74/512 |
| 3,975,972 | 8/1976 | Muhleck | 74/512 |
| 3,988,945 | 11/1976 | Fasano | 74/512 |

FOREIGN PATENT DOCUMENTS 4976127 5/1976 Fed. Rep. of Germany .

*Primary Examiner*—Gerald P. Tolin

*Attorney, Agent, or Firm*—Fitzpatrick, Cella, Harper & Scinto

[57] ABSTRACT

An adjustable footrest that can be set to any height, angular orientation and horizontal position and then locked by manipulation of a locking lever. The locking lever rotates to turn and release various clamping arrangements to permit free adjustment of the footrest.

26 Claims, 4 Drawing Figures

ADJUSTABLE FOOTREST

BACKGROUND OF THE INVENTION

1. Field of the Invention

This invention concerns a footrest attached to a supporting frame and having arrangements for adjustment of its height, its angular position and/or its horizontal position relative to the supporting frame.

2. Description of the Prior Art

Footrests of the above type, which in some cases are equipped with an electric switch that can be operated with the foot by a person seated, are used, for example, at work locations such as assembly benches.

Anatomical differences in persons demand, for reasons of occupational physiology, that the footrest be adjustable in height, in angular position and/or in horizontal position. In conventional prior art footrests such adjustment has been effected by means of screw elements which are guided in slots on the supporting frame and which are loosened by means of wrenches or by way of wing nuts; and, after adjustment, are again tightened or locked.

Such adjustments are quite time-consuming and require not only strength but manual dexterity as well. Moreover, since it is usually women who work, particularly on piecework at work locations provided with footrests of this kind, these prior art adjustment possibilities are usually not implemented.

It is therefore an object of the invention to provide a footrest whose position, e.g. height and angular orientation, is continuously adjustable, in simple fashion, from a seated position, and with minimal effort.

SUMMARY OF THE INVENTION

According to one aspect of the present invention there is provided a footrest which is adjustable in height. The adjustable footrest comprises a footrest member and a supporting frame. A lever is connected at one end with the footrest member and is pivoted at its other end to the supporting frame. A link is attached to the frame and serves to guide a rod connected with the footrest member. A clamping arrangement is provided for locking the rod to the link and a locking lever is provided for releasing and locking the clamping arrangement in the link.

According to a further aspect of the present invention there is provided a footrest in which the footrest member can be angularly adjusted or tilted about an axis. According to this aspect of the invention there is provided a guide concentric with the tilt axis and a clamping arrangement by which the footrest member, by way of the guide, is lockable in relation to the supporting frame. More specifically, a rotary member is provided for rotating an element of the clamping arrangement for locking and unlocking the clamping arrangement; and a locking lever is provided to cooperate with the rotary member for rotation of the rotary member.

According to a still further aspect of the invention there is provided a footrest in which the footrest member can be horizontally adjusted. According to this aspect, a supporting frame is guided horizontally on a base. An anchoring arrangement is provided integral with the base and a clamping arrangement is provided for locking the supporting frame to the anchoring arrangement. Further, a locking lever is arranged to cooperate with the clamping arrangement for locking and unlocking the clamping arrangement.

The adjustable footrest of this invention is preferably provided with arrangements wherein a single locking lever may be used to provide both height and angular adjustment.

To facilitate the adjustment procedure, there may be provided in the arrangement for height adjustment and, optionally and alternatively, in the arrangement for horizontal adjustment, a spring arrangement exerting a resilient force. The spring arrangement is preferably attached to the supporting frame and is formed for example with at least one spring element arranged to exert force, at least indirectly, between the footrest member and the supporting frame.

In order to provide continuous adjustability the clamping arrangement for height-adjustment is designed as an eccentric mechanism, while the clamping arrangement for the angular position adjustment arrangement is designed as a screw mechanism.

The clamping arrangements used to maintain height and angular position each have two parts, one of which is capable of rotation by the locking lever for locking and unlocking of the clamping arrangement, while the other part is secured so as not to rotate.

Where both height adjustment and angular adjustment arrangements are used together, the footrest is designed such that the footrest member is adjustable angularly independently of the height adjustment when the clamping arrangement is released or unlocked. This feature is achieved by having the footrest member mounted so that it is tiltable about a mounting which is guided for height setting.

The footrest is preferably supported at both sides, with at least one clamping arrangement being provided at one side of the footrest, and the locking lever projecting from there to a location where it may easily be grasped by a person using the footrest.

BRIEF DESCRIPTION OF THE DRAWINGS

The invention is explained in greater detail by means of the embodiment represented in the drawing, in which.

DETAILED DESCRIPTION OF THE PREFERRED EMBODIMENT

Figure 1:
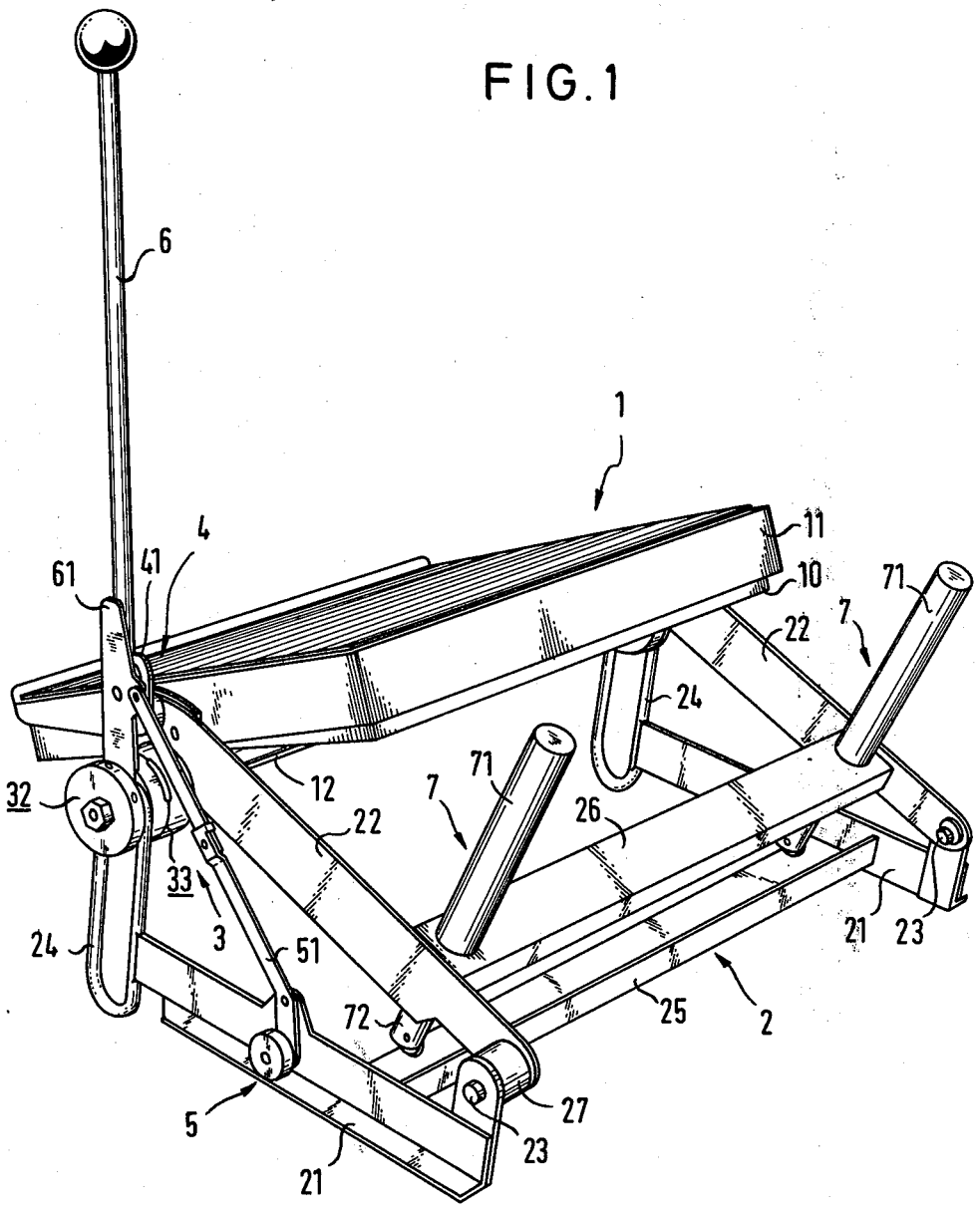
FIG. 1 is a perspective view of an adjustable footrest apparatus embodying the present invention.

In FIG. 1 a footrest member 1 is mounted to a supporting or base frame 2. A height-adjustment arrangement 3, an angular-adjustment arrangement 4 and a horizontal-adjustment arrangement 5 are mounted on the frame 2 and support the footrest member 1. Each of these adjustment-arrangements are capable of actuation, that is, they are releasable and lockable, by a single locking lever 6, permit the footrest member 1 to be set and fixed in a position convenient for the user.

The supporting frame 2 has a pair of rigid base frame members 21. Support levers 22, connected at one end with the footrest member 1, are pivotally connected at their opposite end to swivel about hinge pins 23 at one end of the base frame members 21. Links 24 are fixed to extend upwardly from the other end of the base frame members 21 for supporting the footrest member 1 itself. The links 24 serve to guide lockable mountings for the footrest member 1 which mountings are connected to the support levers 22. Adjustment of these mountings, as will be explained, is the height-adjustment arrangement 3.

The footrest member 1 is guided in the links 24 by means of a rod 31 extending through the support levers 22. The rod 31 is relatively non-movable in relation to the footrest member 1. At each end of the rod 31 there is provided a stop 32 lying outside the link 24. At least one of these stops is adjustable by means of a threaded washer **32*a* and a lock nut 32*b*, which are screwed on a thread 31*a* of the rod 31** and there secured.

Figure 2:
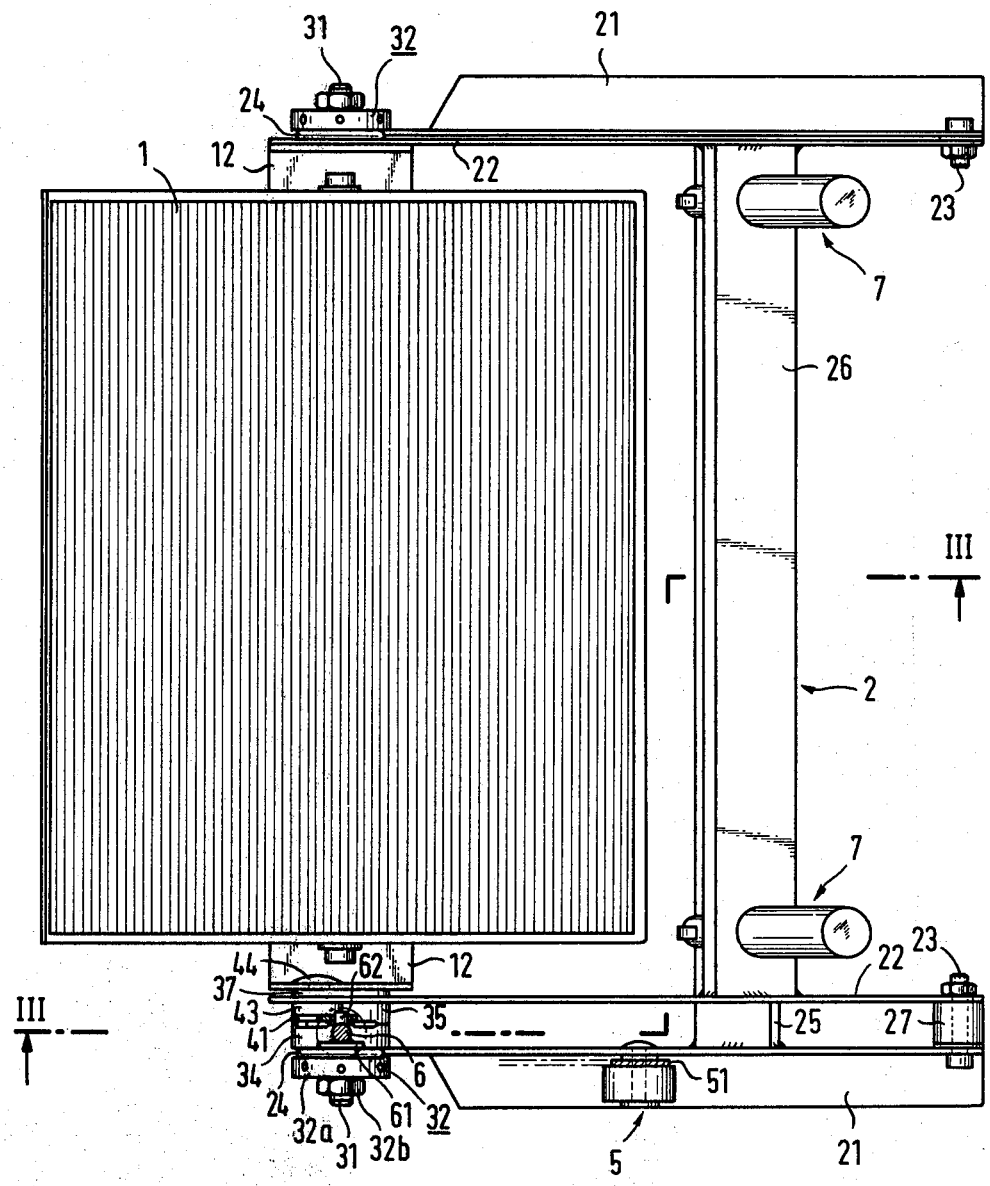
FIG. 2 is a top view of the footrest apparatus of FIG. 1.
Figure 4:
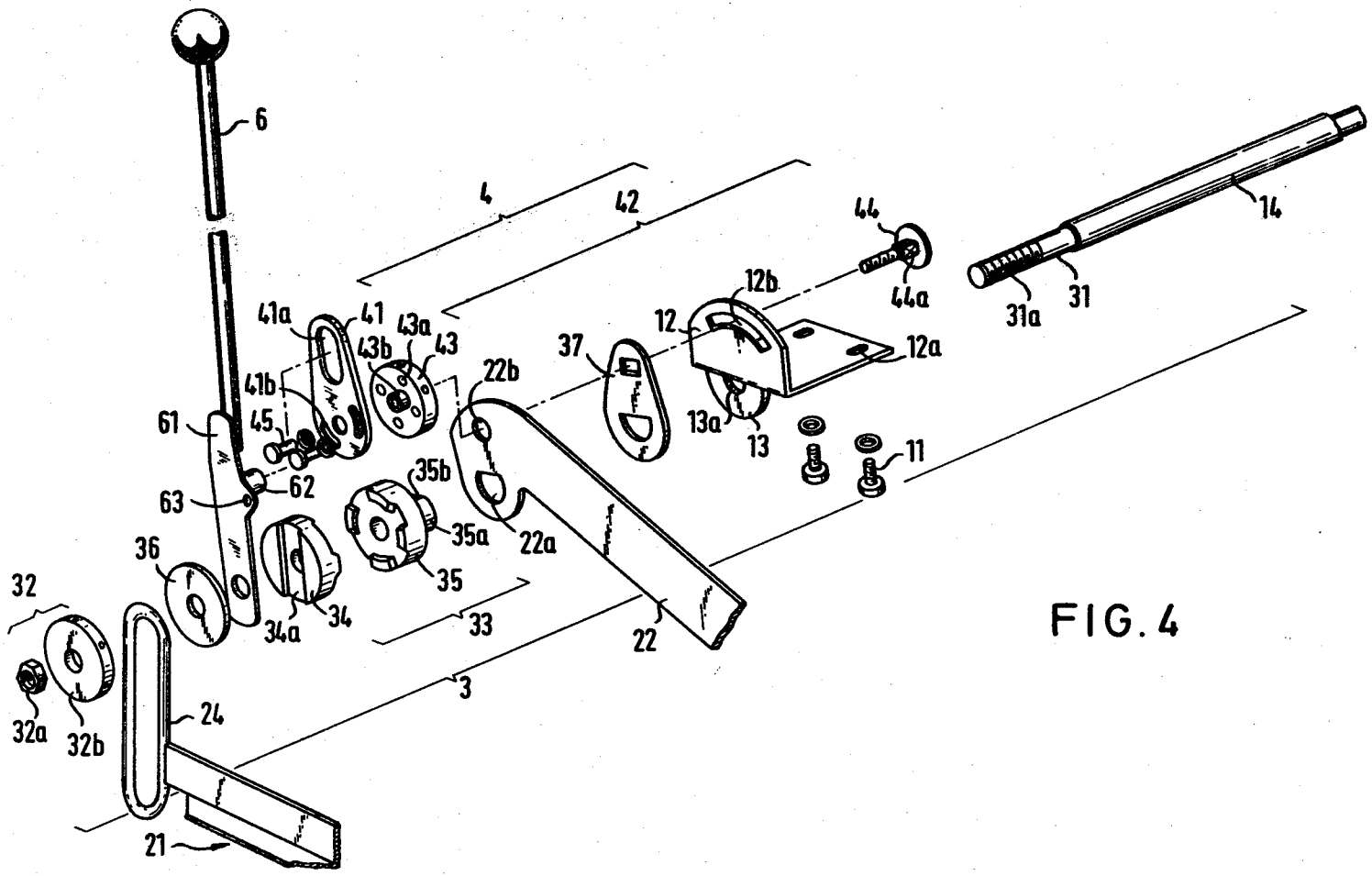
FIG. 4 is an exploded view, illustrating an assembly of height and angle adjustment elements forming a part of the footrest apparatus of FIG. 1.

Between the stop 32, or the link 24, and the footrest 1, or the hinged support lever 22, on one side of the footrest member 1, there is provided a clamping arrangement which is capable of release and locking by tilting of the locking lever 6. In the illustrated embodiment, and as shown in FIGS. 2 and 4, this clamping arrangement comprises an eccentric mechanism 33, having a first part 34, connected so as to rotationally fixed with respect to the locking lever 6, and a second part 35 connected so as to be rotationally fixed with respect to the support lever 22.

The rotationally fixed connection between the first eccentric mechanism part 34 and the locking lever 6 is carried out by means of a flat piece 61, which engages a matching groove or recess **34*a* of the part 34. The rotationally fixed connection between the second eccentric mechanism part 35 and the hinged support lever 22 is carried out in that on the part 35 there is provided a cylindrical shoulder 35*a* with flat 35*b* (FIG. 4), which engages in a matching opening 22*a* of the support lever 22**.

In the locked or clamped state of the clamping arrangement formed by the eccentric mechanism 33, mutually facing projections of the eccentric parts 34, 35 are rotationally brought into alignment so that they contact each other and develop a spreading force which is exerted on the link 24 against the stops 32 mounted on the rod 31. This spreading force is so strong that the footrest member 1 can no longer be moved up and down by application of foot pressure of a seated person using the adjustable footrest.

Upon release or unlocking of the clamping arrangement, which is obtained by rotation of the locking lever 6 in such fashion that the projections of one eccentric part engage in the recesses of the other eccentric part, the spreading action is relieved at least sufficiently to permit a seated person to bear upon the footrest 1 and move it upward or downward in the link 24.

The magnitude of the clamping force provided by the clamping mechanism may be adjusted by setting the spacing of the stops 32 on the rod 31, which need be preset only once, although a further adjustment may be made, if necessary.

It is, of course, alternatively possible to make the spacing of the stops 32 on the rod 31 adjustable in some other way, for example by means of a castellated nut or the like mounted on the rod 31 by way of a cotter pin. In the case where the supporting frame 2 is made sufficiently rigid in the section thereof between the two links 24, the locking action may alternatively be obtained solely by the spreading force exerted by means of the eccentric mechanism 33.

In order to protect the surfaces of the links 24, the stop 32 and the eccentric mechanism 33, there is preferably provided between these parts a broad bearing surface, which may be secured, for example, by means of a washer 36 (FIG. 4), or by the suitable sizing of the parts, as is represented in the case of the threaded washer **32*a***.

To obtain simultaneous, continuous adjustment of the angular position of the footrest by actuation of the single locking lever 6, the angular-adjustment arrangement 4 is preferably designed as represented in FIG. 4.

The angular adjustment arrangement 4 has a rotary lever 41 controlled by the locking lever 6, which lever 41 is connected to be rotationally fixed with respect to a rotary part 43 of a threaded mechanism 42. In the embodiment shown, the part 43 of the threaded mechanism 42 connected with the rotary lever 41 is a threaded piece designed similar to a nut. The connection between the locking lever 6 and the rotary lever 41 is effected by way of a shoulder 62 on the locking lever, preferably on the flat piece 61 thereof; and this shoulder 62 engages in a matching slot **41*a* of the rotary lever 41. A screw 44 is provided as a non-rotational threaded counterpart of the threaded part 43. Owing to rotation of the threaded coupling part 43 by means of the rotary lever 41 in relation to the threaded screw 44, the footrest is locked or clamped to, or unlocked or released from, the support lever 22. The lever support 22 has an opening 22*b* through which the screw 44 passes to permit controlled swivelling of the locking lever 6**.

Tilting of the footrest in relation to the threaded mechanism 42 is effected by way of footrest supports 12, attached to the footrest member 1, for example with screws 11 which pass through a first flange extending at one angle from the support. To allow for manufacturing tolerances in the footrest member 1, the screws 11 pass through slots **12*a* of the footrest support 12. In another flange extending at a second angle from the footrest support 12 there is provided a curved guide slot 12*b* concentric to the axis of rotation of the foot rest. The threaded screw 44 engages the slot 12*b* such that, with the threaded mechanism 42 released, the screw 44 is displaceable along the slot without being capable of rotation. This limited movement, without corresponding screw rotation, is obtained by the provision, near the head of the screw 44, of a collar section 44*a* having a rectangular cross-section. The dimensions of the collar section 44*a* match those of the concentric slot 12*b*. For tilting the footrest member 1 about a swivel axis, which is formed by the axis of the rod 31, the footrest support 12 has a shoulder 13 extending downwardly from the flange containing the slot 12*b*. The shoulder 13 has a passage 13*a* for the rod 31**.

For supporting the spacer mounting between the footrest supports 12 and for keeping spreading forces as uniform as possible in the unlocked and in the locked state, there is provided between the footrest supports 12, surrounding the rod 31, a sleeve 14, which is capable of tilting with the footrest member 1 and which either rests against or engages in the shoulders 13.

In order to be able to adjust the clamping force between the two parts 43, 44 of the threaded mechanism 42 such that a reliable clamping effect is obtained by movement of the locking lever 6 (this movement in the illustrated embodiment also serving to produce the clamping action in the height-adjustment arrangement 3), the rotary lever 41 is angularly adjustable in relation to the threaded coupling part 43 of the threaded mechanism 42. This is obtained by means of screws 45 which are guided in slots 41*b* concentric to the axis of rotation. The screws 45 engage in corresponding threaded holes 43*a* of the threaded coupling part 43, while such threaded holes 43*a* are provided at regular angular distances about the face of the threaded coupling part 43 which faces the rotary lever 41. For optimum guidance of the screw 44 and the threaded coupling part 43 the latter has a shoulder 43*b* projecting through the rotary lever 41. The cooperation between the height-adjustment arrangement 3 and the angular-adjustment arrangement 4 is optimized by the provision of an intermediate washer 37. This washer engages and is rotationally fixed with respect to the part 35 of the eccentric mechanism 33, which in turn is connected and is rotationally fixed with respect to the support lever 22. The intermediate washer 37 also engages and is rotationally fixed with respect to the threaded counterpart piece 44 of the threaded mechanism 42.

The horizontal-adjustment arrangement 5 (FIG. 1) is designed in an essentially similar fashion and, as shown, comprises a clamping arrangement such as an eccentric mechanism, a screw mechanism or a toggle mechanism. In order to effect rotation of the part causing the clamping there is provided a lever 51, which is connected with the locking lever 6 and which is preferably hingedly attached to a shoulder 63 of the flat piece 61. Depending on the particular clamping mechanism used, anchor elements attached to the base and the base frame members 21 are thereby clamped or locked by compression or by spreading apart against one another.

In order to support the footrest member 1 after release of the respective clamping arrangement by tilting of the locking lever 6, for example, when the footrest is being adjusted by a rested person, there is provided a spring arrangement 7, such as for example helical or leaf springs, cooperating with the height-adjustment arrangement 3. The spring arrangement 7 exerts a resilient force such that when the clamping arrangement is released, the footrest member 1 is forcibly moved upwardly to the upper end of the link 24. A similar spring arrangement (not shown) may also be provided to force the supporting frame 2 in the horizontal direction toward the operator when the clamping arrangement for the horizontal-adjustment arrangement 5 is released or unlocked. The spring arrangement 7 therein is preferably attached to the supporting frame 2 itself, but it may be of course alternatively be attached to the base members 21.

Figure 3:
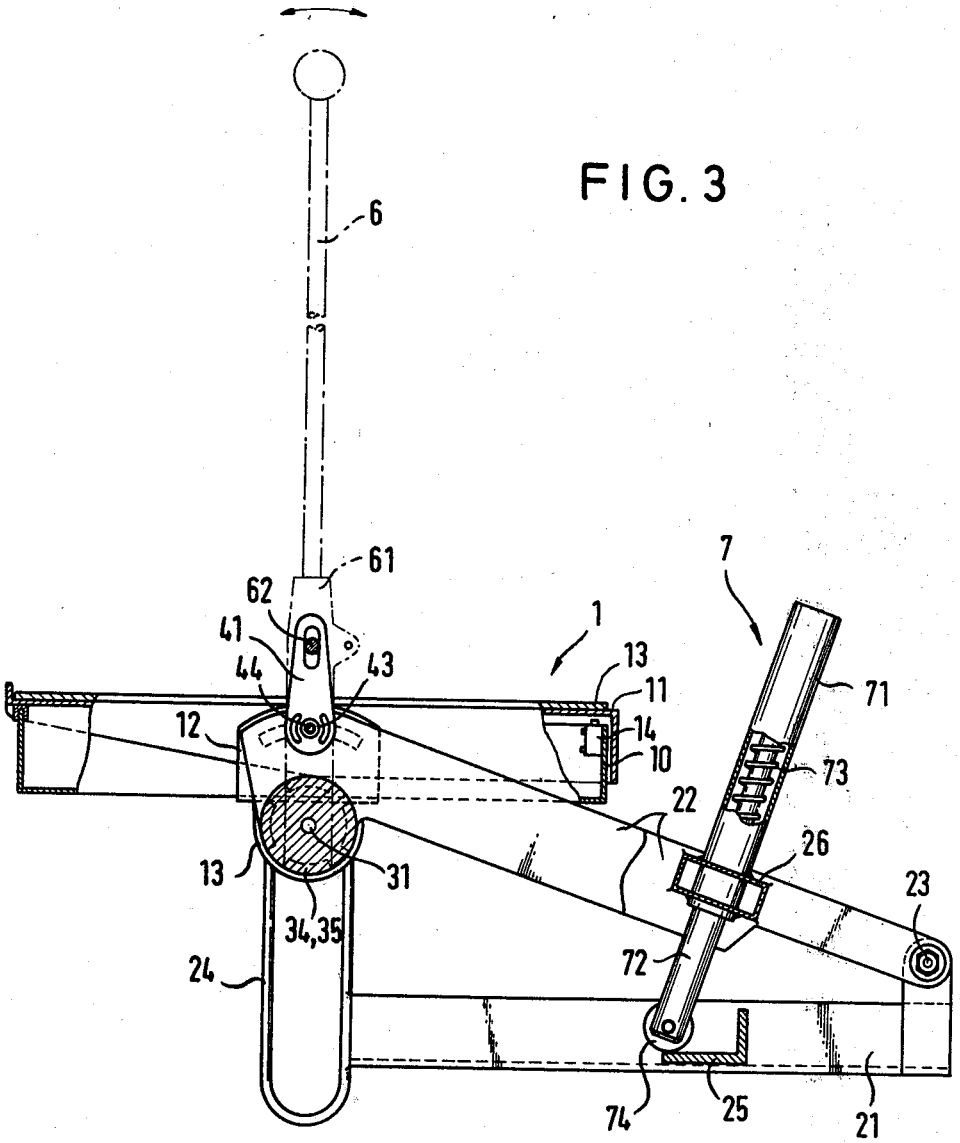
FIG. 3 section takes along line III—III in FIG. 2.

The attachment and the mode of operation of the spring arrangement 7 may be seen in detail in FIG. 3. In the example there represented, a cross brace 25 interconnects the base members 21; and a further cross brace 26 is shown interconnecting the hinged support levers 22. In the illustrated embodiment a lifting cylinder 71 is attached to the cross brace 26 of the support lever 22 while a piston rod 72, moveable in the cylinder, presses downwardly against the cross brace 25 of the base frame 21 by the action of a spring 73 arranged in the inside of the lifting cylinder. This action tilts the support lever 22 upwardly in relation to the base members 21. The lower end of the piston rod 72 therein is preferably in contact with the cross brace 25 by way of rollers 74. The action of this spring and piston and cylinder arrangement may alternatively be effected directly on the base frame members 21. In addition, instead of the spring 73, some other arrangement for exerting the necessary force, such as for example, a hydraulic lifting cylinder or the like, may alternatively be provided. In the case of the illustrated embodiment, two such spring arrangements 7 are provided near the support levers 22. There may of course alternatively be provided a single spring arrangement 7, which is then preferably located in the center of the brace 26. More than two spring arrangements 7 may also be provided. Further, the spring arrangement 7 may alternatively be provided at the outer side of the support lever 22, where this is expedient.

Since the clamp arrangements require a certain axial length, the connection between the support lever 22 adjacent to the clamp arrangements is designed to compensate for such axial length. In the illustrated embodiment this compensation is obtained by a sleeve 27 provided at the hinge pins 23. Alternatively the support lever 22 may be formed with an offset. In addition, the horizontal-adjustment arrangement be anchored to the floor.

As illustrated in FIG. 1 and more specifically in FIG. 3 the footrest member 1 is formed of two parts 11 and 10, which are capable of tilting relative to each other. A foot support 13, for example of rubber, is provided on the uppermost part 11. The lower part 10, which is of tub-like shape, may contain electric foot switches 14, or the like, which are connected in a suitable manner (not shown) to turn other devices on and off electrically upon actuation. Actuation of the foot switch 14 is effected by tilting of the upper part 11 in relation to the lower part 10 in such fashion that a control lever of the foot switch 14 is depressed.

The footrest member 1 may be designed such that when it is adjusted, the foot switch 14 is not actuated. This may be achieved by arranging the locking lever 6 such that the circuit to the device controlled by the foot switch 14 is interrupted when the lever 6 is tilted. Alternatively, the two parts 10 and 11 of the footrest may be designed such that a distinctly greater force is required to tilt one with respect to the other than is required for adjusting the footrest when the angular-adjustment clamping arrangement is released upon tilting of the locking lever 6.

The operation of the footrest pursuant to the invention will now be explained with respect to the release procedure followed in the case of a seated person who may be working on piecework.

The seated person places his or her feet on the footrest member 1 and, with his or her hand, shifts or tilts the locking lever 6 to release all the clamping arrangements as above described. The person upon pressing the footrest member 1 for example against the force of the spring arrangement 7, adjusts the footrest member 1 angularly, in height and horizontally until a desired comfortable position is reached. At this point the user merely tilts the locking lever 6 back in the other direction and thereby locks all the clamping arrangements. Because the locking lever 6 extends into the region of the hand of the person seated, great leverage may be exerted on the clamping arrangements, whereby a very good clamping effect may be obtained in the various clamping arrangements even when the person performing the tilting movement, for example a woman, is relatively weak. The entire adjustment procedure may be carried out in a few seconds, so that it may easily be performed by woman working on piecework without their fearing a loss of income. Moreover, the invention permits the user to vary the footrest position repeatedly, thereby increasing comfort and productivity of the user.

It should be noted that continuous adjustability of the footrest 1 in angular direction and in height cannot be obtained with the eccentric mechanism 33 alone, since, as tests by the inventor have shown, such locking does not suffice for both adjustments. While a friction gear might enable one to achieve such angle and height adjustment with a single eccentric mechanism, no continuous adjustment would thereby be obtainable. Further, such friction gears, particularly those having a fine tooth pitch, are costly to manufacture.

The present invention accordingly provides a footrest in which adjustments in angular orientation, in height and in horizontal directions can be carried out following a single unlocking operation and in which successive unlocking adjustment and locking operations can be carried out with minimal difficulty even while rested. The footrest, moreover, may be portable and in such case feet may be attached to the supporting frame 2. Alternatively, the footrest may be anchored at a permanent work location.

I claim:

1. An adjustable footrest comprising a footrest member, a supporting frame and a height adjustment arrangement interconnecting said footrest member and said supporting frame, said height adjustment arrangement comprising a support lever connected at one end with the footrest and pivoted at its other end to the supporting frame, a link attached to the supporting frame, a rod connected with the footrest and guided for movement along the link, said footrest member being carried on said rod to pivot with respect to the frame, a height adjustment clamping arrangement on the rod for locking the rod to the link, a pivot adjustment clamping arrangement for clamping said footrest member to said frame and a locking lever connected with both the clamping arrangements such that movement of the locking lever in one direction releases both said clamping arrangements to allow height and pivotal adjustment of said footrest member and movement of said locking lever in the opposite direction locks said footrest member against both height and pivotal movement.

2. An adjustable footrest according to claim 1, wherein said height adjustment arrangement includes resilient means arranged to exert an upward force on said footrest member.

3. An adjustable footrest according to claim 1 or 2, wherein the clamping arrangement comprises an eccentric mechanism having a first part mounted on the locking lever for rotation therewith and a second part which does not rotate with respect to said support lever, said rod extending axially through said parts, said parts having faces which cooperate to produce opposing forces when the parts are rotated with respect to each other to clamp said link between an element on said rod and said eccentric mechanism.

4. An adjustable footrest according to claim 3, wherein a stop is provided on said rod with said link being located between said stop and said eccentric mechanism.

5. An adjustable footrest according to claim 3, wherein said one part of the eccentric mechanism has a recess in the side thereof facing away from the other part and wherein said locking lever is fitted into said groove for rotation of said one part with said locking lever.

6. An adjustable footrest according to claim 1, and further including an arrangement for adjustment of the angular position of the footrest member in the supporting frame wherein said arrangement comprises a footrest support to which said footrest member is attached and which is mounted to tilt about an axis, said footrest support being formed with a guide extending concentric to said axis, and a clamping arrangement by which the footrest support at said guide is lockable in relation to the supporting frame, said clamping arrangement including a rotary member which, upon rotation, operates to release and lock said clamping arrangement, and means arranged to rotate the rotary member.

7. An adjustable footrest according to claim 6, wherein the clamping arrangement comprises a threaded coupling element and a threaded counterpart element, one of which elements is accommodated in the guide to be guidable therealong while the other element projects through the support lever of the supporting frame and threadedly engages the one element, and wherein the rotary member rotates one of said elements and the other of said elements being held from rotation.

8. An adjustable footrest according to claim 6 wherein said means arranged to rotate the rotary member comprises a portion of said locking lever.

9. An adjustable footrest according to claim 8, wherein the rotary member is a rotary lever fixed to the threaded coupling element of the clamping arrangement, said rotary lever engaging a driving part of said locking lever to be driven rotationally thereby.

10. An adjustable footrest according to claim 9, wherein said driving part of said locking lever is a projection integral therewith which projection engages in a slot of the rotary lever.

11. An adjustable footrest according to claim 9 wherein an adjustable connection is provided between said rotary lever and said threaded coupling element, said adjustable connection being constructed so that, upon release thereof, there is permitted a change in rotational position between the rotary lever and said threaded coupling element.

12. An adjustable footrest according to claim 6 wherein the guide formed on said footrest support is a slot and wherein said clamping arrangement includes a non-rotational part engageable with said rotary member, said non-rotational part being dimensioned to be closely guided in said slot.

13. An adjustable footrest according to claim 6, characterized in that the footrest support is formed with first flanges attached to said footrest member and further flanges having openings therethrough at said axis, with said rod extending through said openings and a sleeve extending between said further flanges.

14. An adjustable footrest according to claim 13, characterized in that said sleeve surrounds said rod.

15. An adjustable footrest according to claim 3 wherein an intermediate washer engages and is rotatable with said second part of the eccentric mechanism and further engages and is non-rotatable with respect to said other element of said clamping arrangement.

16. An adjustable footrest according to claim 1, and further including an arrangement for adjustment of the supporting frame in the horizontal direction, comprising an anchor means integral with the base, on which anchor means the supporting frame is horizontally guided, a further clamping arrangement for clamping the supporting frame to the anchor means, and actuating means cooperating with the clamping arrangement for locking and unlocking of the further clamping arrangement.

17. An adjustable footrest according to claim 16, wherein said actuating means comprises a further portion of said locking lever.

18. An adjustable footrest according to claim 16 wherein said further clamping arrangement is an eccentric mechanism.

19. An adjustable footrest according to claim 16 wherein said further clamping arrangement includes a toggle mechanism.

20. An adjustable footrest according to claim 17 wherein said locking lever is connected to said further clamping arrangement by way of a hinged lever hingedly attached to a rotational portion of the clamping device for locking same.

21. An adjustable footrest according to claim 16 wherein a spring arrangement is provided exerting a horizontal adjustment force between said footrest member and said frame.

22. An adjustable footrest according to claim 21 wherein said spring arrangement is attached to the supporting frame.

23. An adjustable footrest according to claim 1 wherein said supporting frame is constructed to support said footrest member on both sides thereof.

24. An adjustable footrest according to claim 1 wherein said locking lever projects up from said supporting frame to a location for convenient manipulation by a person using the footrest.

25. An adjustable footrest according to claim 1 wherein said footrest member includes at least one foot switch actuable by pressure on said footrest member upon locking of same with respect to said supporting frame.

26. An adjustable footrest according to claim 25 wherein said foot switch is arranged to be rendered inoperable by unlocking of said footrest member with respect to said adjustment frame.

* * * * *